US006660984B1

(12) United States Patent
Jeong et al.

(10) Patent No.: US 6,660,984 B1
(45) Date of Patent: Dec. 9, 2003

(54) WALL-MOUNTED TYPE MICROWAVE OVEN

(75) Inventors: Sang-Jin Jeong, Suwon (KR); Sang-Seok Seo, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/321,440

(22) Filed: Dec. 18, 2002

(30) Foreign Application Priority Data

Jul. 2, 2002 (KR) ..... 2002-37792

(51) Int. Cl.[7] ..... H05B 6/80

(52) U.S. Cl. ..... 219/757; 219/756; 219/702; 126/21 A; 126/273 A; 126/299 R

(58) Field of Search ..... 219/757, 756, 219/702, 715, 758, 681, 400; 126/299 R, 299 D, 273 A, 275 E, 21 R, 21 A

(56) References Cited

U.S. PATENT DOCUMENTS 4,254,450 A * 3/1981 White et al. ..... 219/757

FOREIGN PATENT DOCUMENTS

| | | | |
|---|---|---|---|
| JP | 1-272087 | * 10/1989 | ..... 219/758 |
| KR | 2001-55487 | 7/2001 | |
| KR | 10-0353358 | 9/2002 | |

* cited by examiner

*Primary Examiner*—Philip H. Leung
(74) *Attorney, Agent, or Firm*—Staas & Halsey LLP

(57) ABSTRACT

A wall-mounted type microwave oven having an improved structure to hold a power cord on a top panel of the wall-mounted type microwave oven thereby affording easy assembly and reduction in manufacturing costs is provided. The power cord extends out of the top panel through an opening thereof. The power cord is fitted into a cut portion formed in the top panel to be connected to the opening, and a cover having a retaining portion is attached to the top panel to cover the opening. Therefore, the power cord is interposed between the retaining portion of the cover and the top cover, and is thus firmly held on the top panel.

15 Claims, 3 Drawing Sheets

10
14
14a
16
17
19
20
21
22
30
31
40
41
42
50
51
60
61
62
63
70
72
73
C

WALL-MOUNTED TYPE MICROWAVE OVEN

CROSS-REFERENCE TO RELATED APPLICATIONS

This application claims the benefit of Korean Application No. 2002-37792, filed Jul. 2, 2002, in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven, in which a structure for holding a power cord on a top panel of oven body of the wall-mounted type microwave oven is improved so as to afford easy assembly and reduction of manufacturing cost.

2. Description of the Related Art

In general, a wall-mounted type microwave oven is mounted on a kitchen wall over a gas oven and not only carries out a cooking operation, but also exhausts gas and fumes generated from the gas oven disposed below the wall-mounted type microwave oven.

The wall-mounted type microwave oven includes an oven body having a cooking chamber and an electric component compartment therein, each being isolated from one another. An exhaust flow path is defined between outer surfaces of the cooking chamber and the electric component compartment and the oven body to allow gas and fumes generated from the gas oven disposed below the oven body to be exhausted therethrough.

The exhaust flow path is disposed around the cooking chamber and the electric component compartment. A bottom panel of the oven body is provided with intake ports so as to allow the gas and fumes existing below the oven body to be introduced into the oven body therethrough. The oven body is provided at an upper portion of the oven body with an exhaust fan to discharge the gas and fumes, introduced into the oven body, to an outside.

The wall-mounted type microwave oven includes a power cord to supply an electric current from an external power source to a power supply provided in the oven body, the power cord being outwardly extended from the oven body. The power cord is usually extended from the oven body through the top panel of the oven body. Since the oven body of the wall-mounted type microwave oven is usually mounted on a kitchen wall so as to be closely interposed between kitchen cabinets, to take the power cord out of the oven body through a rear surface or side surfaces of the oven body is difficult, and heat generated from the gas oven disposed below the oven body can disadvantageously be transmitted to the power cord if the power cord is extended from the microwave oven body through the bottom panel of the oven body of the wall-mounted type microwave oven.

Referring to FIGS. 1A and 1B, a substantial part of a conventional wall-mounted type microwave oven is shown. As shown in FIGS. 1A and 1B, a top panel 2 of an oven body 1 is provided with a lead-out hole 4, through which a power cord 3 is extended from the oven body 1. A plug 3*a* is coupled to a free end of the power cord 3 extended from the oven body 1. The power cord 3 is provided with a holding piece 5 to hold the power cord 3 on the top panel 2. The holding piece 5 includes a peripheral groove 5*a* formed at a peripheral surface of the peripheral groove 5*a* such that the peripheral groove 5*a* of the holding piece 5 is engaged with a holding edge 4*a* formed adjacent to the lead-out hole 4.

After the holding piece 5 of the power cord 3 is held by the holding edge 4*a* of the lead-out hole 4, a cover 6 is attached to the top panel 2. The cover 6 is attached to the top panel 2 by screws 7 to cover the lead-out hole 4. The cover 6 is provided at one side of the cover 6 with a retainer 6*a* which is adapted to surround a portion of the holding piece 5 so as to prevent the holding piece 5 from being separated from the holding edge 4*a*.

However, since the above-described conventional wall-mounted type microwave oven requires additional components, such as the cover 6 to hold the power cord 3 on the top panel 2, manufacturing cost become high. Further, since the cover 6 must be attached to the top panel 2 of the oven body 1 by screws, assembling time of the wall-mounted type microwave oven is increased, thereby deteriorating productivity.

SUMMARY OF THE INVENTION

Accordingly, a wall-mounted type microwave oven is provided, in which a holding structure of a power cord is improved so as to assure easy assembly and reduction of manufacturing cost.

Additional aspects and advantages of the invention will be set forth in part in the description which follows and, in part, will be obvious from the description, or may be learned by practice of the invention.

In order to accomplish the above and other aspects, a wall-mounted type microwave oven is provided comprising: a top panel defining an upper surface of an oven body and having an opening allowing an exhaust fan assembly to be received into the oven body therethrough; a cover removably attached to the top panel to cover the opening; and a power cord which is pulled from the oven body through the opening and held on the top panel by an attachment of the cover.

The power cord may be provided with a holding piece, which includes a peripheral groove between upper and lower surfaces of the holding piece. The top panel may be provided with a cut portion to be connected to the opening, so that edges of the top panel defining the cut portion are engaged with the peripheral groove of the holding piece. The cover may be provided with a retaining portion to support the holding piece which is fitted into the cut portion of the top panel.

The cut portion may be formed at an edge of the top panel defining the opening, and the retaining portion may be provided at an edge of the cover to support an upper surface and a side surface of the holding piece.

BRIEF DESCRIPTION OF THE DRAWINGS

These and other aspects and advantages of the invention will become apparent and more readily appreciated from the following description of the preferred embodiments, taken in conjunction with the accompanying drawings of which.

DESCRIPTION OF THE PREFERRED EMBODIMENTS

Figures 1A, 1B:
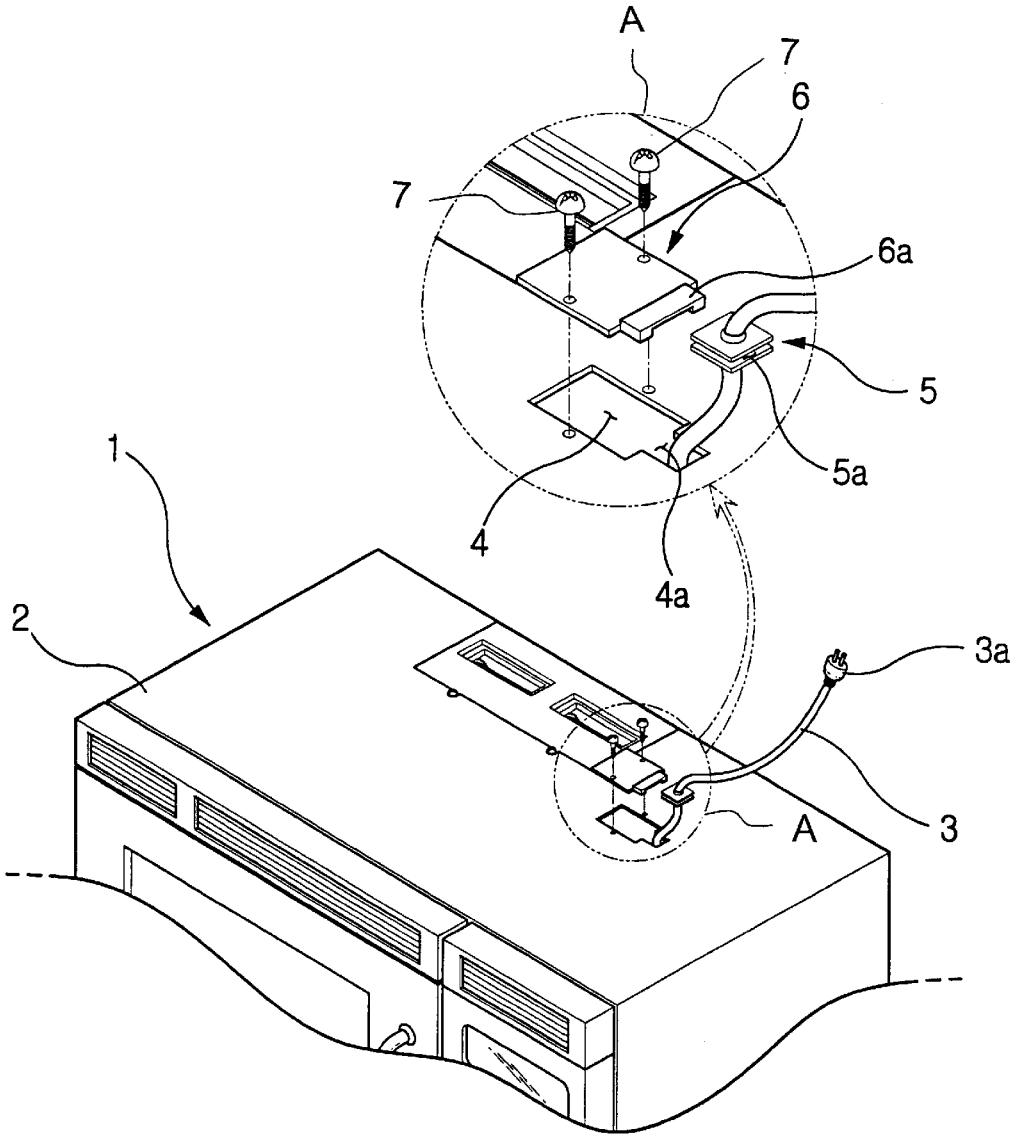
FIG. 1B (PRIOR ART)
FIG. 1A (PRIOR ART)
FIG. 1A is a partial perspective view of a conventional wall-mounted type microwave oven.
FIG. 1B is an exploded view of FIG. 1A at area A.

Reference will now made in detail to the present preferred embodiments of the present invention, examples of which are illustrated in the accompanying drawings, wherein like reference numerals refer to the like elements throughout. The embodiments are described below in order to explain the present invention by referring to the figures.

Figures 2A, 2B:
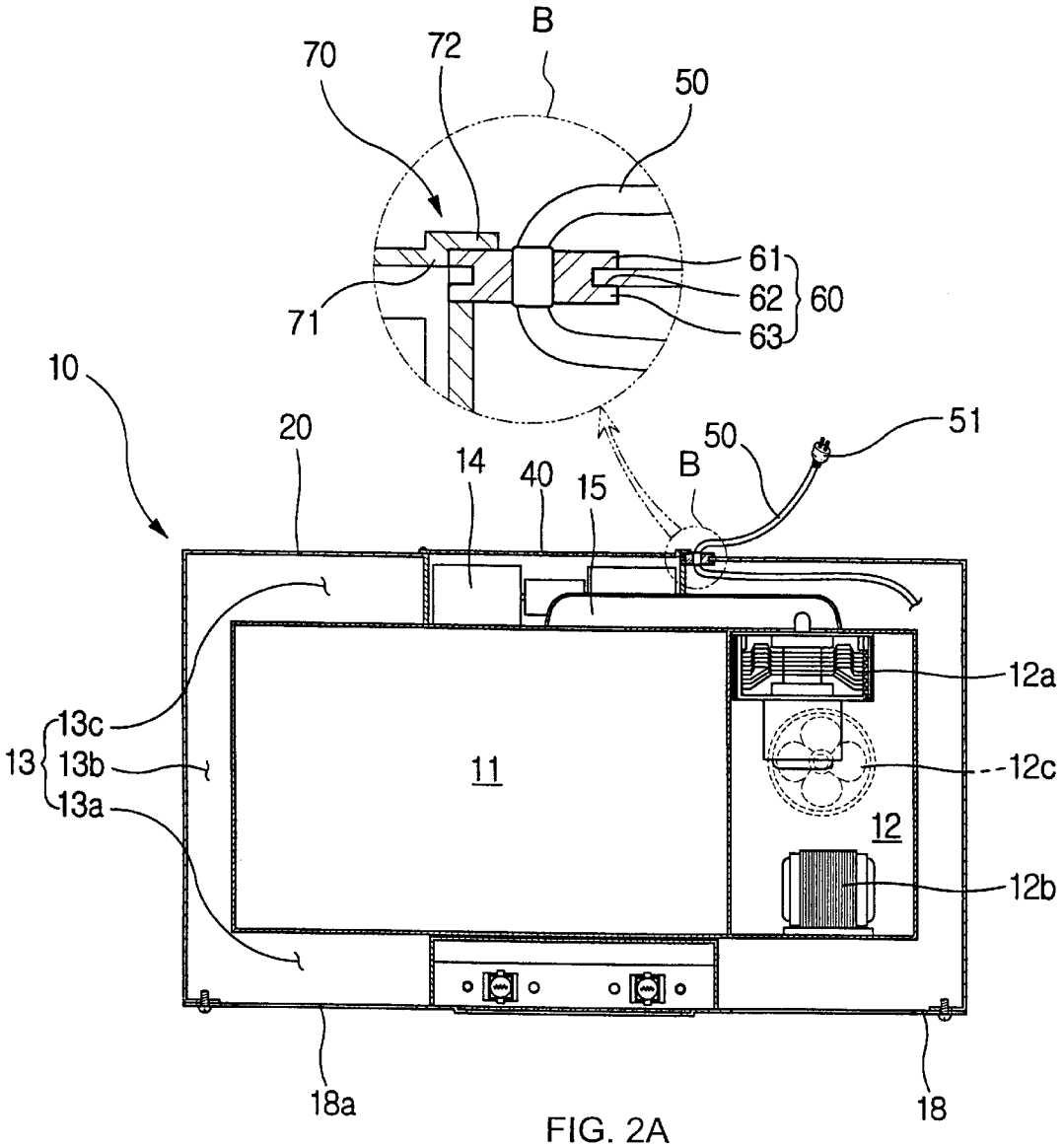
FIG. 2A is a cross-sectional view of a wall-mounted type microwave oven according to an embodiment of the present invention.
FIG. 2B is an exploded view of FIG. 2A at area B.
Figures 3A, 3B:
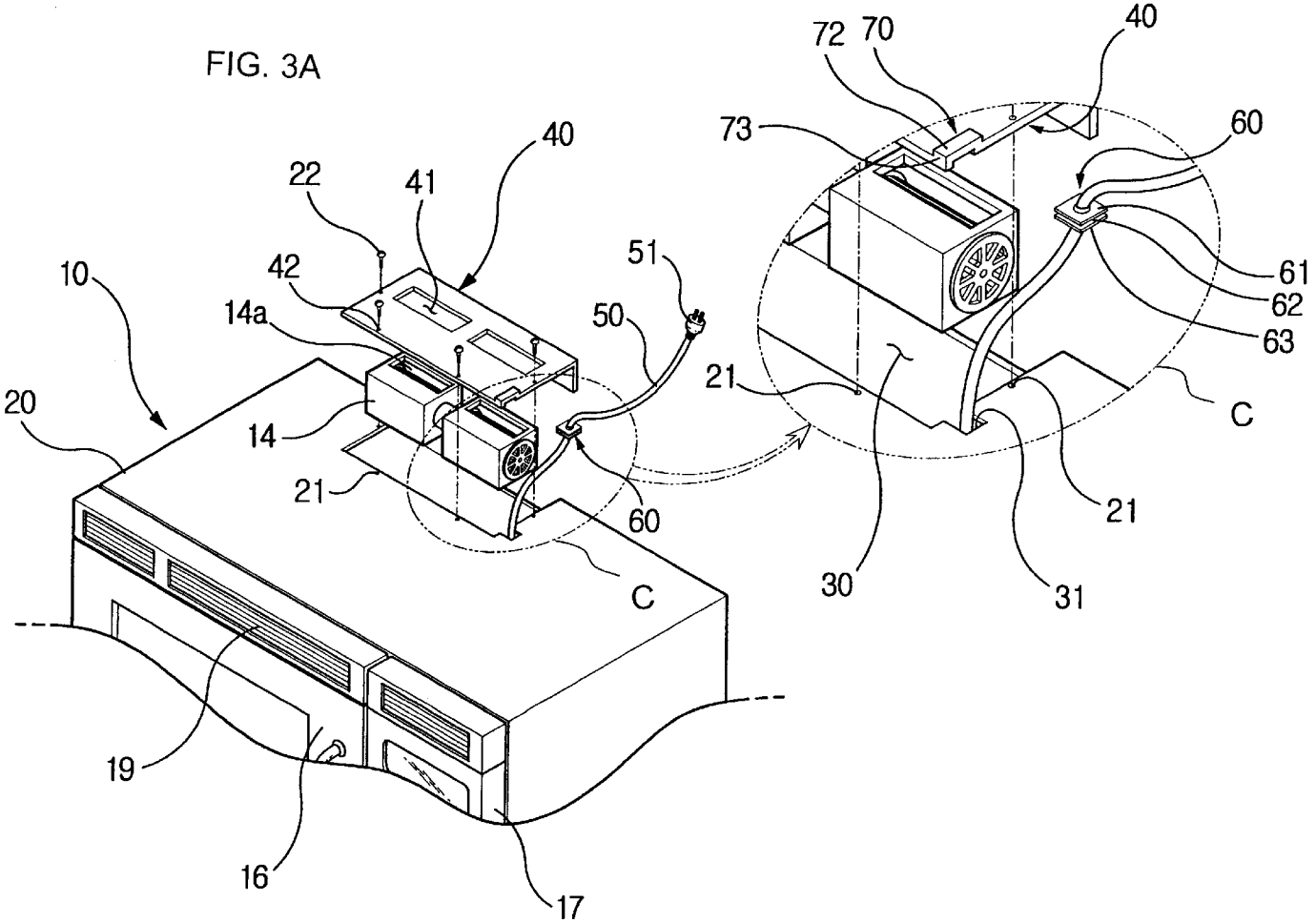
FIG. 3A is a partial perspective view of the wall-mounted type microwave oven shown in FIG. 2.
FIG. 3B is an exploded view of FIG. 3A at area C.

As shown in FIGS. 2A, 2B, 3A and 3B, a wall-mounted type microwave oven includes an oven body 10, which is divided by a partition plate, into a cooking chamber 11 to cook food therein, and an electric component compartment 12 which accommodates various electric components. The oven body 10 is provided with an exhaust flow path 13 therein, which is isolated from the cooking chamber 11 and the electric component compartment 12, to exhaust gas and fumes generated from a gas oven (not shown) disposed below the oven body 10. The oven body 10 is further provided at an upper and rear portion of the oven body 10 with an exhaust fan assembly 14 to discharge the gas and fumes introduced into the exhaust flow path 13.

The electric component compartment 12 is equipped with a magnetron 12*a* therein to generate high-frequency electromagnetic waves into the cooking chamber 11, a high voltage transformer 12*b* for applying high voltage to the magnetron 12*a*, and a cooling fan 12*c* to cool the electric component compartment 12. A waveguide 15 is disposed on the cooking chamber 11 and the electric component compartment 12 to guide high-frequency electromagnetic waves, generated from the magnetron 12*a*, into the cooking chamber 11. The oven body 10 is provided at a front face of the oven body 10 with a door 16 and a control panel 17, such that the door 16 is openably coupled to the oven body 10 to close the cooking chamber 11, and the control panel 17 is disposed on the front face of the electric component compartment 12. The control panel 17 includes a plurality of control buttons to control various functions of the microwave oven and a display to display an operational condition of the microwave oven.

The exhaust flow path 13 comprises a lower path section 13*a* defined between a bottom surface of the cooking chamber 11 and the electric component compartment 12 and a bottom panel 18 of the oven body 10, two rising path sections 13*b* vertically disposed beside the cooking chamber 11 and the electric component compartment 12 respectively, and an upper path section 13*c* disposed on a top of the cooking chamber 11 and the electric component compartment 12 between a top surface of the cooking chamber 11 and a top panel 20 of the oven body 10 to guide the gas and fumes, introduced into the rising path sections 13*b*, to the exhaust fan assembly 14. The bottom panel 18 of the oven body 10 is formed with a pair of intake ports 18*a* to allow the gas and fumes existing therebelow to be introduced into the oven body 10. Further, the gas and fumes are introduced into the oven body 10 through the intake ports 18*a*, and then discharged from the oven body 10 through the lower path section 13*a*, the rising path sections 13*b* and the upper path section 13*c*, when the exhaust fan assembly 14 is operated.

The exhaust fan assembly 14 includes discharge openings 14*a* to discharge the gas and fumes, introduced into the exhaust flow path 13, to an outside. The gas and fumes discharged through the discharge openings 14*a* can be directed in a desired direction such that the discharge openings 14*a* of the exhaust fan assembly 14 are positionably directed to the desired direction, for example, upwardly and forwardly. To allow the gas and fumes to be discharged through the discharge openings 14*a* when the discharge openings 14*a* are directed forwardly, the oven body 10 is provided at a front face with a front discharge outlet 19 positioned on the door 16 and the control panel 17.

The top panel 20 of the oven body 10 is provided with an opening 30, so that the exhaust fan assembly 14 is removable from the oven body 10, thereby allowing the discharge openings 14*a* to be directed to the desired direction and to be repaired. A cover 40 having upper discharge outlets 41 is detachably attached to the top panel 20 of oven body 10 to close the opening 30 such that the gas and fumes are discharged upwardly through the discharge openings 14*a* when the discharge openings 14*a* are directed upward. The cover 40 is attached to the top panel 20 of the oven body 10 by tightening screws 22 into threaded holes 21 formed at the top panel 20 adjacent to the opening 30 through screw holes 42 formed at a circumferential edge of the cover 40.

The wall-mounted type microwave oven includes a power cord 50, which serves to allow an electric current from an external power source (not shown) to be supplied to a power supply (not shown) provided in the oven body 10. The power cord 50 is outwardly extended from the oven body 10. The power cord 50 is usually extended from the top panel 20 of the oven body 10, because a rear face of the oven body 10 and both side faces of the oven body 10 are in close contact with a kitchen wall and kitchen cabinets and the bottom panel 18 of the oven body 10 is exposed to heat from a gas oven (not shown) disposed therebelow.

The free end of the power cord 50 is coupled to a plug 51, which is inserted into a socket (not shown) provided on a appropriate wall of a kitchen. Another end of the power cord 50, disposed in the oven body 10, is connected to the power supply (not shown) supplying electric current to various electric components of the microwave oven. The power cord 50 is further provided with a holding piece 60 to hold the power cord 50 on the top panel 20.

In the wall-mounted type microwave oven, the power cord 50 is extended from the top panel 20 of the oven body 10 through the opening 30, which is formed at the top panel 20 to allow the exhaust fan assembly 14 to be received into the oven body 10 therethrough. Accordingly, the power cord 50 is held at the opening 30 on the top panel 20 by an attachment of the cover 40 to the top panel 20.

The structure used to hold the power cord 50 on the top panel of the oven body will now be described in detail.

The holding piece 60 adapted to hold the power cord 50 is formed as a rectangular plate, which comprises an upper plate 61 and a lower plate 62 with an engaging groove 62 defined therebetween, all of which are integrally formed. In connection with the holding piece 60, the top panel 20 is formed with a cut portion 31 so as to allow edges of the cut portion 31 to be engaged with the engaging groove 31 of the holding piece 60.

The cut portion 31 is formed at the top panel 20 extending from the opening 30. Consequently, once the holding piece 60 is fitted into the cut portion 31, the holding piece 60 is firmly held on the top panel 20 by engagement of the upper and lower plates 61 and 63 of the holding piece 60 and the top panel 20 corresponding to the edges of the cut portion 31.

After the holding piece 60 is fitted into the cut portion 31 of the top panel 20, the cover 40 is attached to the top panel 20 such that the peripheral edge of the cover 40 is placed on the edge portion of the top panel 20 defining the opening 30. The cover 40 is provided at one side of the cover 40 with a retainer 70, which is adapted to surround a portion of the holding piece 60 so as to prevent the holding piece 60 from being separated from the cut portion 31.

The retainer 70 is integrally formed with the cover 40, and includes a vertical portion 71 adapted to support a side surface of the upper plate 61 of the holding piece 60, a horizontal portion 72 extended from an upper end of the vertical portion 71 and adapted to support an upper surface of the upper plate 61, and two vertical side portions 73 downwardly extended from respective opposite sides of the horizontal portion 72 and adapted to support respective opposite side surfaces of the upper plate 61 of the holding piece 60. Further, since the respective opposite side surface of the holding piece 60 are supported by the vertical portion 71 of the retainer 70 and the upper surface of the holding piece 60 is supported by the horizontal portion 72 of the retainer 70 once the cover 40 is attached to the top panel 20, the holding piece 60 fitted into the cut portion 31 can be firmly held on the top panel 20 without being separated from the cut portion 31 toward the opening 30.

The operation of holding the power cord of the wall-mounted type microwave oven according to the embodiment of the present invention will now be described.

First, the power cord 50 is connected at one end thereof to the power supply (not shown), and outwardly extends out of the oven body 10 through the opening 30. The holding piece 60, fixed to the power cord 50, is fitted into the cut portion 31 connected to the opening 30 by an engagement of the engaging groove 62 of the holding piece 60 and the edge of the cut portion 31. The exhaust fan assembly 14 is mounted in the oven body 10 through the opening 30, and the cover 40 is attached to the top panel 20 such that the screws 22 are tightened into the threaded holes 21, formed in the top panel 20 adjacent to the opening 30, through the screw holes 42 formed in the cover 40. The opposite side surfaces and the upper surface of the holding piece 60 fitted into the cut portion 31 are supported by the retainer 70 formed at the cover 40. Accordingly, the holding piece 60 cannot be separated from the cut portion 31, and the power cord 50 can be securely held on the top panel 20 by the engagement of the holding piece 60.

As described above, a wall-mounted type microwave oven with an improved structure to hold a power cord on the top panel of the oven body is provided. Accordingly, the power cord is held on the top panel of the oven body such that a power cord extends out of the oven body through the opening, which is provided in the top panel to allow an exhaust fan assembly to be received into the oven body therethrough, and a holding piece fixed to the power cord is fitted into the cut portion connected to the opening and by attaching a cover to the top panel the opening is covered. Since additional components to hold the power cord are therefore not necessary, manufacturing cost of the microwave oven is reduced and assembling efficiency of the microwave oven is improved.

Although a preferred embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A wall-mounted type microwave oven comprising:
   - a top panel defining an upper surface of an oven body and having an opening allowing an exhaust fan assembly to be received into the oven body therethrough;
   - a cover removably attached to the top panel to cover the opening; and
   - a power cord which extends from the oven body through the opening and held on the top panel by an attachment of the cover.

2. The microwave oven as set forth in claim 1, wherein the power cord is provided with a holding piece, which includes a peripheral groove between upper and lower surfaces, of the holding piece wherein the top panel is provided with a cut portion to be connected to the opening, so that edges of the top panel defining the cut portion are engaged with the peripheral groove of the holding piece, and wherein the cover is provided with a retaining portion to support the holding piece which is fitted into the cut portion.

3. The microwave oven as set forth in claim 1, wherein a cut portion is formed at an edge of the top panel defining the opening, and a retaining portion is provided at an edge of the cover to support an upper surface and a side surface of a holding piece.

4. A wall-mounted type microwave oven having an oven body, comprising:
   - a top panel;
   - an opening defined by the top panel in the oven body such that the opening allows exhausting of air to an outside and supplying of power to the microwave;
   - a single cover removably coupled to the top panel to cover the opening; and
   - a power cord extending through the opening and held on the top panel by attaching the single cover to the top panel.

5. The microwave oven as set forth in claim 4, further comprising:
   - an exhaust fan assembly disposed in the opening exhausting air from the oven body.

6. The microwave oven as set forth in claim 5, wherein the exhaust fan assembly comprises:
   - discharge openings and is removably disposed in the opening, thereby allowing the discharge openings to be directed to a desired direction to exhaust air from the oven body.

7. The microwave oven as set forth in claim 4, wherein:
   - the power cord comprises,
     - a holding piece to hold the power cord comprising, upper and lower plates, and
       - a groove therebetween; and
   - the top panel has a cut portion defined by edges thereof, the cut portion being adjacent to the opening, the cut portion and the groove of the holding piece being engagable.

8. The microwave oven as set forth in claim 7, wherein the cover comprises:
   - a retaining portion to support the holding piece which is engaged with the cut portion; and
   - upper discharge outlets to direct exhaust to an outside of the oven body.

9. The microwave oven as set forth in claim 7, wherein the cover surrounds a portion of the holding piece so as to prevent the holding piece from separating from the cut portion.

10. The microwave oven as set forth in claim 7, further comprising:

a retainer integrally formed with the cover comprising:

a vertical portion to support a side surface of the upper surface of the holding piece;

a horizontal portion extending from an upper end of the vertical portion to support an upper surface of the holding piece; and two vertical side portions downwardly extended from respective opposite sides of the horizontal portion to support respective opposite side surfaces of the holding piece.

11. The microwave oven as set forth in claim 4, further comprising:

a holding piece to hold the power cord, wherein the cover comprises, a retaining portion disposed at an edge of the cover to support an upper surface and a side surface of the holding piece.

12. The microwave oven as set forth in claim 4, wherein the cover comprises:

discharge openings and is removably disposed in the opening, thereby allowing the discharge openings to be directed to a desired direction to exhaust air from the oven body.

13. A wall-mounted type microwave oven having an oven body, comprising:

a top panel;

a power cord;

a holding piece to hold the power cord;

an opening defined by the top panel in the oven body having a cut portion such that the opening allows exhausting of air to an outside and supplying of power to the microwave, the power cord extending through the opening at the cut portion and held on the top panel; and a single cover removably coupled to the top panel to cover the opening, wherein the single cover engages the holding part on at least three sides thereof.

14. The microwave oven as set forth in claim 13, wherein the single cover engages the holding part engages the holding part on four sides thereof.

15. A wall-mounted type microwave oven having an oven body, comprising:

a top panel having a cut portion defined by edges thereof;

an opening defined by the top panel in the oven body adjacent to the cut portion such that the opening allows exhausting of air to an outside and the cut portion allows supplying of power to the microwave;

a single cover removably coupled to the top panel to cover the opening and a portion of the cut portion;

a power cord extending through the cut portion and held on the top panel by attaching the single cover to the top panel; and a holding piece slideably engagable into the cut portion to hold the power cord, wherein the single cover comprises a vertical portion to support a side of the holding piece, a horizontal portion extending from an upper end of the vertical portion to support an upper surface of the holding piece, and two vertical side portions downwardly extended from respective opposite sides of the horizontal portion to support respective opposite sides of the holding piece.

* * * * *